US011209233B1

(12) United States Patent
Oglesby

(10) Patent No.: US 11,209,233 B1
(45) Date of Patent: Dec. 28, 2021

(54) MUZZLE DEVICE MOUNTING SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 16/816,693

(22) Filed: Mar. 12, 2020

Related U.S. Application Data

(63) Continuation-in-part of application No. 16/555,595, filed on Aug. 29, 2019, now abandoned.

(60) Provisional application No. 62/817,019, filed on Mar. 12, 2019, provisional application No. 62/772,304, filed on Nov. 28, 2018, provisional application No. 62/724,712, filed on Aug. 30, 2018.

(51) Int. Cl.
*F41A 21/32* (2006.01)

(52) U.S. Cl.
CPC ..... *F41A 21/32* (2013.01)

(58) Field of Classification Search
CPC ..... F41A 21/30; F41A 21/32; F41A 21/325; F41A 21/34; F41A 21/36; F41A 21/38
USPC ..... 181/223; 89/14.2–14.4
See application file for complete search history.

(56) References Cited

U.S. PATENT DOCUMENTS 7,661,349 B1 * 2/2010 Brittingham ..... F41A 21/34 89/14.4
7,676,976 B2 * 3/2010 Dueck ..... F41A 21/325 42/90
8,499,676 B1 * 8/2013 Moore ..... F41A 21/325 89/14.2
8,555,765 B2 * 10/2013 Graham, II ..... F41A 21/325 89/14.4
8,763,510 B2 * 7/2014 Dueck ..... F41A 21/26 89/14.5
9,513,078 B1 * 12/2016 Fulton ..... F41A 21/30
9,921,021 B1 * 3/2018 Graham, II ..... F41A 21/325
10,082,354 B1 * 9/2018 Lee ..... F41A 21/325
10,082,355 B2 9/2018 Addis
10,480,888 B2 * 11/2019 Barrett ..... F41A 21/30
10,670,362 B2 * 6/2020 Wilson ..... B23K 35/304
10,801,796 B2 * 10/2020 Kras ..... F41A 21/325
2012/0272818 A1 * 11/2012 Dueck ..... F41A 21/325 89/14.4
2014/0237881 A1 * 8/2014 Mack ..... F41A 21/325 42/90

* cited by examiner

*Primary Examiner* — Troy Chambers
*Assistant Examiner* — Benjamin S Gomberg
(74) *Attorney, Agent, or Firm* — Shaddock Law Group, PC

(57) ABSTRACT

A muzzle device mounting system having an outer collar; an inner collar attached or coupled to the outer collar, wherein the outer collar is in a fixed rotational position relative to the inner collar; a muzzle device positioned at least partially between the inner collar and the outer collar, wherein the muzzle device is rotatable relative to the outer collar and the inner collar; and a pawl lever pivotably positioned relative to the outer collar and the inner collar, wherein the pawl lever includes an engagement surface for engaging one or more splines of a muzzle adapter, and wherein the pawl lever is slidable relative to the outer collar and the inner collar along a longitudinal axis of the outer collar and the inner collar.

18 Claims, 18 Drawing Sheets

MUZZLE DEVICE MOUNTING SYSTEM

CROSS-REFERENCE TO RELATED APPLICATIONS

This patent application claims the benefit of U.S. Patent Application Ser. No. 62/817,019, filed Mar. 12, 2019, and is a continuation-in-part of U.S. patent application Ser. No. 16/555,595, filed Aug. 29, 2019, which claims benefit of U.S. Patent Application Ser. No. 62/724,712, filed Aug. 30, 2018, and claims benefit of U.S. Patent Application Ser. No. 62/772,304, filed Nov. 28, 2018, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a muzzle device mounting system for a firearm.

2. Description of Related Art

A muzzle brake is a device that is attached to the terminal end of a muzzle of a firearm that redirects propellant gases to counter recoil and unwanted barrel rise that normally occurs during the normal firing sequence. Muzzle brakes or other devices are typically attached to a firearm barrel via interaction between internal threads of the muzzle device and external threads at the muzzle end of the barrel.

During normal operation of a firearm, and particularly a rifle, when a round is fired, gas from the burning propellant forces the bullet through the barrel. As the bullet travels down and out of the barrel, the bullet and the propellant gases act on barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward.

Muzzle brakes typically utilize one or more slots, vents, holes, and/or baffles to divert and/or redirect the propellant gases as they leave the barrel. Generally, muzzle brakes divert and/or redirect the propellant gases horizontally (left and right), at some angle that is substantially perpendicular to the longitudinal axis of the barrel.

Sound suppressors or "silencers" can also be attached to a firearm barrel by interaction between internal threads of the suppressor and the external threads at the muzzle end of the barrel (thread-on suppressors). Alternatively, a suppressor may be attached to a firearm barrel, via a muzzle device mount or locking lugs.

Over the barrel (OTB) thread-on suppressor systems are by far the most accurate and efficient type of suppressor, but any other muzzle device must be removed from the barrel in order to attach the OTB thread-on suppressor. This leaves the muzzle threads exposed or requires that a muzzle device or thread protector be installed on the muzzle threads.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, there is no current design that allows for the fast and repeatable attachment of a device (i.e., muzzle device, suppressor, etc.) to a barrel in a manner that ensures correct and repeatable timing of the device relative to the barrel.

These and other disadvantages and shortcomings of the prior art are overcome by the features and elements of the muzzle device mounting system of the present disclosure. In various exemplary, nonlimiting embodiments, the muzzle device mounting system of the present disclosure allows a muzzle adapter to be fitted to a barrel rather than a fixed flash hider or brake as current designs allow.

The muzzle device mounting system allows a muzzle adapter with a conical taper to be fitted to a barrel. In various exemplary embodiments the muzzle device is semi-permanently attached or coupled to the barrel. The timing of the muzzle adapter to the barrel may optionally be adjusted, for example, using timing shims.

The muzzle device mounting system uses interaction of a conical taper formed proximate the front or muzzle end of the muzzle adapter and a tapered recess portion of a muzzle device to assist in centering the muzzle device relative to the muzzle adapter. The muzzle adapter flats formed on the muzzle adapter may also optionally be aligned with muzzle device flats formed within the muzzle device recess of the muzzle device for alignment of the muzzle device with the muzzle adapter, such that the interaction of the muzzle device flats with the muzzle adapter flats stops the muzzle device from rotating, relative to the muzzle adapter and barrel, so that the muzzle device can be perfectly "timed" with the barrel. The muzzle device may be positioned at least partially within the collar assembly such that the muzzle device can rotate but not come free, rendering the muzzle device at least partially contained within the two part collar.

One or more muzzle adapter flats are formed proximate the muzzle end of the muzzle adapter. The muzzle adapter flats are formed so as to be aligned with corresponding muzzle device flats formed on the inside of a muzzle device that that is intended to be timed to the muzzle adapter, so that these muzzle devices can be easily and repeatably aligned with the muzzle adapter.

A portion of the muzzle device recess includes a muzzle device tapered recess portion. The muzzle adapter also includes a conical taper portion. The tapered recess portion and the conical taper portion are formed so that the muzzle device is auto centered as the muzzle adapter is positioned within the muzzle device.

A ratchet collar is then utilized to pull the muzzle device onto the muzzle adapter mounting surface.

One or more muzzle adapter ports or apertures formed in the muzzle adapter also align with any apertures, ports, or holes in the muzzle device so that muzzle rise control can still be used through both the muzzle adapter and the muzzle device.

The ratchet collar includes a pawl lever, pawl tension element, and pawl pin. There are two portions of the collar that screw together until the respective second ends of the inner collar and outer collar or substantially flush with one another and a hole is formed between the inner collar (providing an inner collar pin recess) and outer collar (providing an outer collar pin recess) that a pawl pin can slide into. The pawl pin now acts as a key between the inner collar and outer collar that stops the inner collar and outer collar from rotating relative to one another or from coming undone. The pawl pin may optionally be spot welded or otherwise affixed in place so that the pawl pin cannot fall out. The two collar portions are now held together with the pawl pin that also captures the pawl and pawl tension element.

The pawl is spring biased to a locked position by a pawl tension element, such as, for example, a coiled spring, which is retained in a pawl tension element recess in the pawl lever around the pawl pin. One leg of the pawl tension element forms a flat area that registers with two notches on the pawl pin (similar to how the auto sear spring works in a M4/M16). The pawl tension element and notched pawl pin allow the pawl lever to be slid backwards and forwards in an engaged and disengaged position.

If the pawl lever is urged or positioned rearward (toward from the barrel of the firearm), the pawl lever is engaged and the engagement surface of the pawl lever is over the raised teeth or splines on the muzzle adapter. If the pawl lever is urged or positioned forward (away from the barrel of the firearm), the pawl lever is disengaged and the engagement surface of the pawl lever is over the smooth section on the mount.

When disengaged, the pawl lever cannot stop the outer collar from rotating relative to the inner collar, making it possible for the muzzle device to be removed, when the pawl lever is in the engaged position, the engagement surface of the pawl lever stops rotation by binding with the radial teeth or splines on the mount.

The outer collar has a relief cut that allows the pawl button to rotate in one direction only.

The system allows an over barrel suppressor to be fitted to the same conical surface and threads reducing point of impact shift from one device to the next. The pawl lever can be disengaged making it easier for the user to grab the collar and remove any devices that have become stuck in place.

The muzzle device mounting system can be used to mount brakes, flash hiders, compensator or a mixture of devices. Suppressors can also be mounted in the same way, or an OTB suppressor can be screwed onto the standard muzzle threads at the end of the barrel.

The advantages of the present disclosure are preferably attained by providing, in an exemplary, nonlimiting embodiment, a muzzle device mounting system, comprising an outer collar; an inner collar attached or coupled to the outer collar, wherein the outer collar is in a fixed rotational position relative to the inner collar; a muzzle device positioned at least partially between the inner collar and the outer collar, wherein the muzzle device is rotatable relative to the outer collar and the inner collar; and a pawl lever pivotably positioned relative to the outer collar and the inner collar, wherein the pawl lever includes an engagement surface for engaging one or more splines of a muzzle adapter, and wherein the pawl lever is slidable relative to the outer collar and the inner collar along a longitudinal axis of the outer collar and the inner collar.

In various exemplary, nonlimiting embodiments, the muzzle adapter is formed so as to be at least partially fitted within an inner collar aperture of the inner collar.

In various exemplary, nonlimiting embodiments, the muzzle adapter includes one or more splines formed at spaced apart locations around at least a portion of the muzzle adapter.

In various exemplary, nonlimiting embodiments, a conical taper portion is formed in at least a portion of the muzzle adapter.

In various exemplary, nonlimiting embodiments, a muzzle device tapered recessed portion is formed within at least a portion of the muzzle device.

In various exemplary, nonlimiting embodiments, the muzzle device mounting system of the present disclosure compromises at least some of a muzzle adapter having a muzzle adapter aperture formed therethrough, wherein at least some external muzzle adapter threads are formed external to least a portion of the muzzle adapter, and wherein a plurality of splines are formed at spaced apart locations around a portion of the muzzle adapter; a muzzle device having a muzzle device recess formed therethrough, wherein a muzzle device capture ring, having an extended outer diameter, extends from a portion of the muzzle device; an outer collar having an outer collar aperture formed therethrough, wherein at least some outer collar internal threads are formed within at least a portion of the outer collar aperture; an inner collar having an inner collar aperture formed therethrough, wherein at least some inner collar threads are formed within at least a portion of the inner collar aperture, wherein the at least some inner collar threads are formed so as to threadedly interact with at least some of the external muzzle adapter threads of the muzzle adapter, wherein at least some external collar threads are formed external to at least a portion of the inner collar, wherein the at least some external collar threads are formed so as to interact with at least some of the outer collar internal threads of the outer collar, and wherein a pawl lever aperture is formed within a portion of the inner collar; and a pawl lever, wherein the pawl lever is pivotably attached, via a pawl pin, between a portion of the inner collar and a portion of the outer collar, at least partially within the pawl lever aperture of the inner collar, wherein the pawl lever is at least partially pivotable between an engaged position and a disengaged position, wherein if the pawl lever is in the engaged position a pawl extension extends to contact one or more of the splines, and wherein the pawl lever is slidable, along at least a portion of the pawl pin such that if the pawl lever is urged rearward relative to the muzzle adapter, a portion of the pawl extension is positioned over at least a portion of the splines and if the pawl lever is urged forward relative to the muzzle adapter, the pawl extension is positioned apart from the splines.

In various exemplary, nonlimiting embodiments, the muzzle adapter comprises a conical taper portion formed proximate a muzzle end of the muzzle adapter.

In various exemplary, nonlimiting embodiments, the muzzle device comprises a tapered recess portion formed in at least a portion of the muzzle device recess to assist in centering the muzzle device relative to the muzzle adapter.

In various exemplary, nonlimiting embodiments, an inner collar pin recess extends along at least a portion of the inner collar body and an outer collar pin recess extends along at least a portion of the outer collar, and wherein the pawl pin is at least partially received within at least a portion of the aligned inner collar pin recess and at least a portion of the outer collar pin recess, such that the pawl pin acts to maintain the inner collar in a fixed rotational position relative to the outer collar.

In various exemplary, nonlimiting embodiments, one or more muzzle device flats are formed within the muzzle device recess of the muzzle device for alignment of the muzzle device with the muzzle adapter.

In various exemplary, nonlimiting embodiments, muzzle adapter threads are formed within at least a portion of the muzzle adapter aperture.

In various exemplary, nonlimiting embodiments, a pawl tension element biases the pawl lever to the engaged position.

In various exemplary, nonlimiting embodiments, if the pawl lever is in the disengaged position the pawl extension is withdrawn from one or more of the splines.

In various exemplary, nonlimiting embodiments, the pawl lever comprises at least some of a finger button portion and an engagement portion.

In various exemplary, nonlimiting embodiments, the muzzle device mounting system of the present disclosure compromises at least some of a muzzle adapter having a muzzle adapter aperture formed therethrough, wherein at least some external muzzle adapter threads are formed external to least a portion of the muzzle adapter, and wherein a plurality of splines are formed at spaced apart locations around a portion of the muzzle adapter; a muzzle device having a muzzle device recess formed therethrough, wherein a muzzle device capture ring, having an extended outer diameter, extends from a portion of the muzzle device; an outer collar having an outer collar aperture formed therethrough, wherein at least some outer collar internal threads are formed within at least a portion of the outer collar aperture; an inner collar having an inner collar aperture formed therethrough, wherein at least some inner collar threads are formed within at least a portion of the inner collar aperture, wherein the at least some inner collar threads are formed so as to threadedly interact with at least some of the external muzzle adapter threads of the muzzle adapter, wherein at least some external collar threads are formed external to at least a portion of the inner collar, wherein the at least some external collar threads are formed so as to interact with at least some of the outer collar internal threads of the outer collar, and wherein a pawl lever aperture is formed within a portion of the inner collar; and a pawl lever, wherein the pawl lever is pivotably attached, via a pawl pin, between a portion of the inner collar and a portion of the outer collar, at least partially within the pawl lever aperture of the inner collar, wherein the pawl lever is at least partially pivotable between an engaged position and a disengaged position, and wherein if the pawl lever is in the engaged position a pawl extension extends to contact one or more of the splines.

Accordingly, the presently disclosed systems, methods, and/or apparatuses provide a muzzle device mounting system that allows for the mounting attachment of brakes, flash hiders, compensator or a mixture of devices to a firearm barrel.

The presently disclosed systems, methods, and/or apparatuses separately provide a muzzle device mounting system that allows a thread-on suppressor or OTB suppressor to be attached to the standard muzzle threads of a firearm barrel.

The presently disclosed systems, methods, and/or apparatuses separately provide a muzzle device mounting system that can be easily manipulated by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
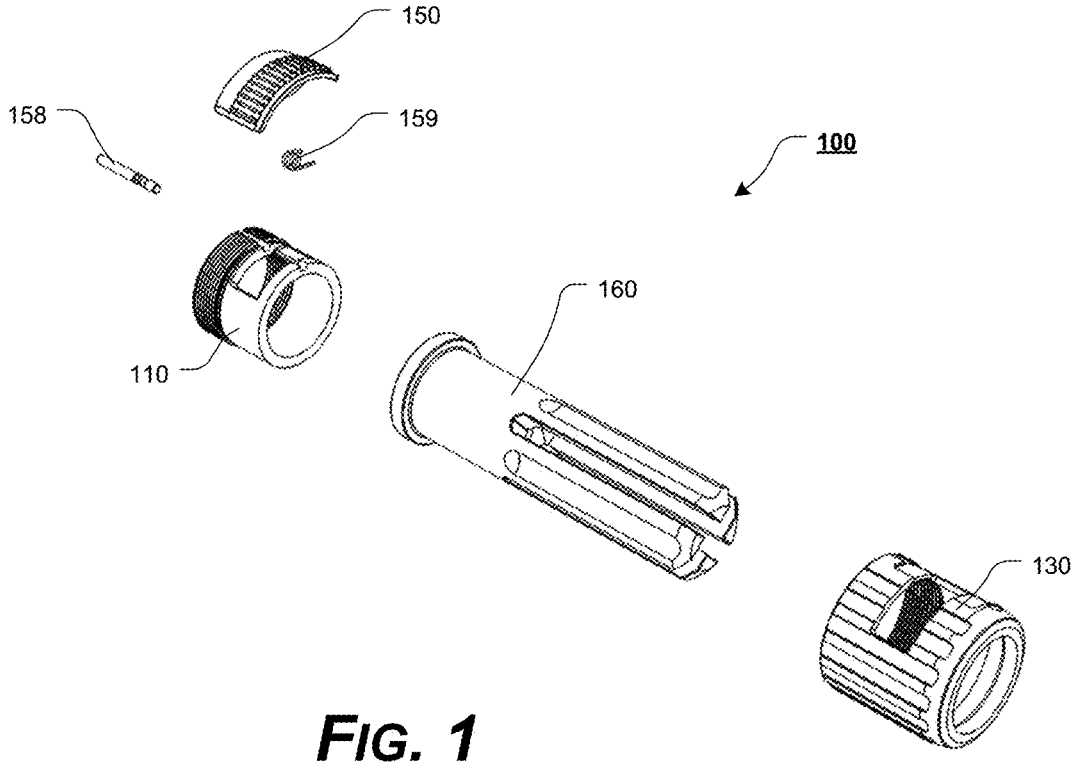
FIG. 1 illustrates an exploded, front perspective view of certain components of an exemplary embodiment of a muzzle device mounting system, according to the presently disclosed systems, methods, and/or apparatuses.
Figure 2:
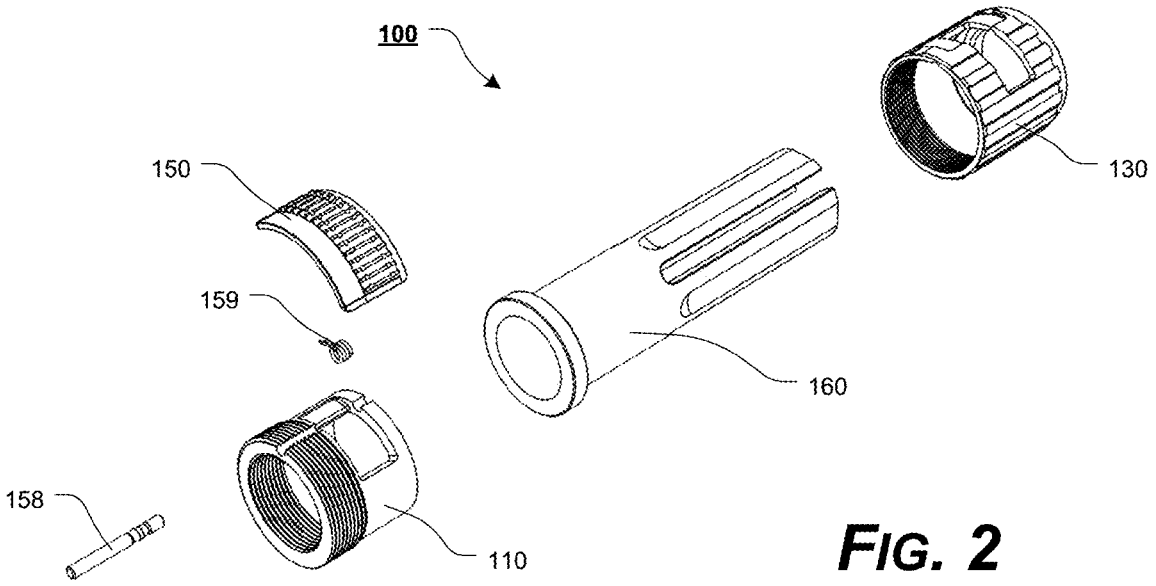
FIG. 2 illustrates an exploded, rear perspective view of certain components of an exemplary embodiment of a muzzle device mounting system, according to the presently disclosed systems, methods, and/or apparatuses.
Figure 3:
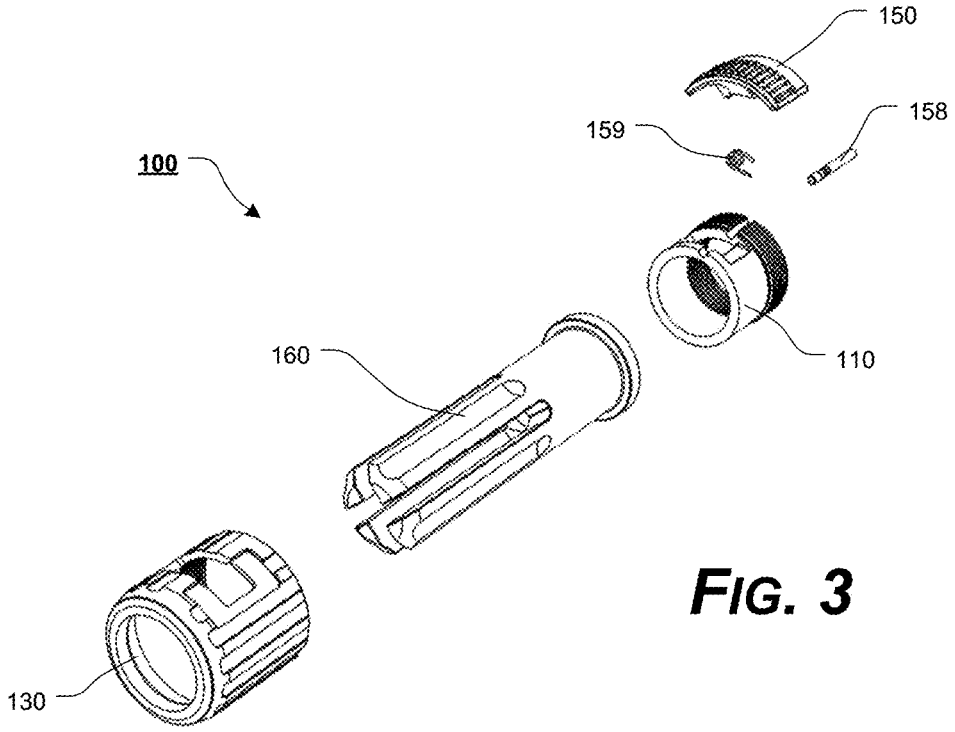
FIG. 3 illustrates an exploded, front perspective view of certain components of an exemplary embodiment of a muzzle device mounting system, according to the presently disclosed systems, methods, and/or apparatuses.
Figure 4:
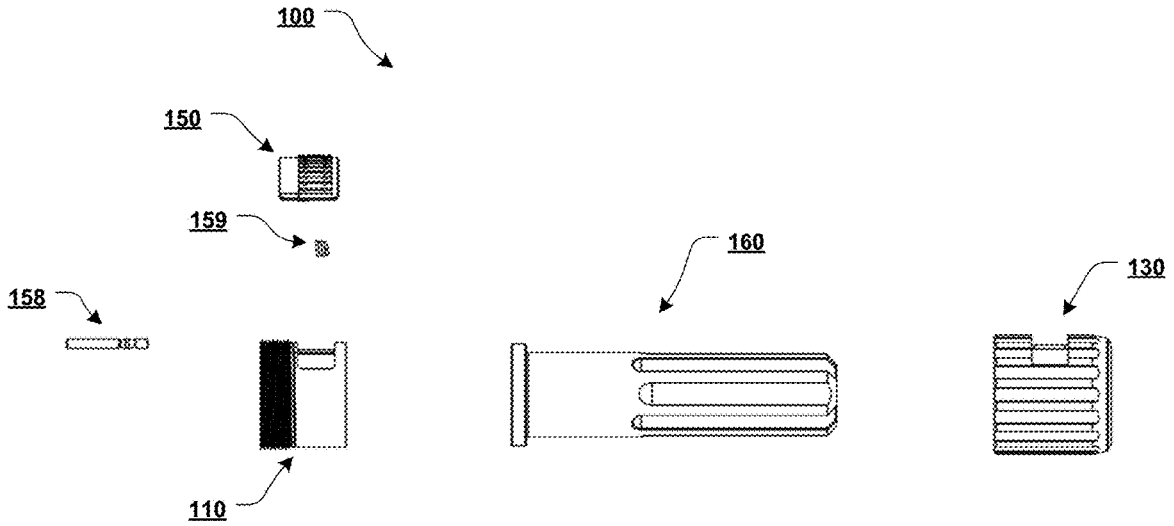
FIG. 4 illustrates an exploded, right side view of certain components of an exemplary embodiment of a muzzle device mounting system, according to the presently disclosed systems, methods, and/or apparatuses.
Figure 5:
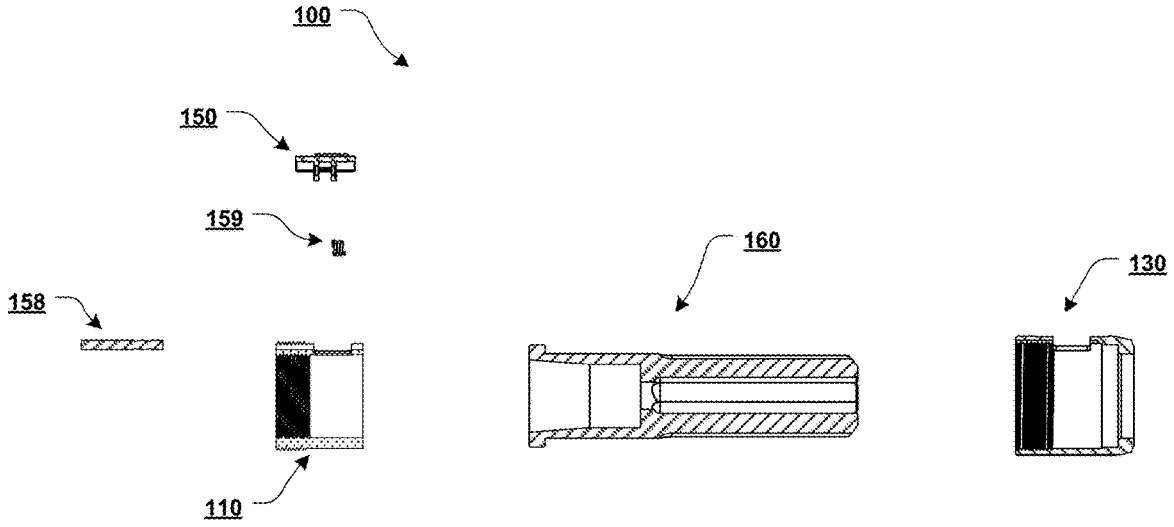
FIG. 5 illustrates an exploded, right side, cross-sectional view of certain components of an exemplary embodiment of a muzzle device mounting system, according to the presently disclosed systems, methods, and/or apparatuses.
Figure 6:
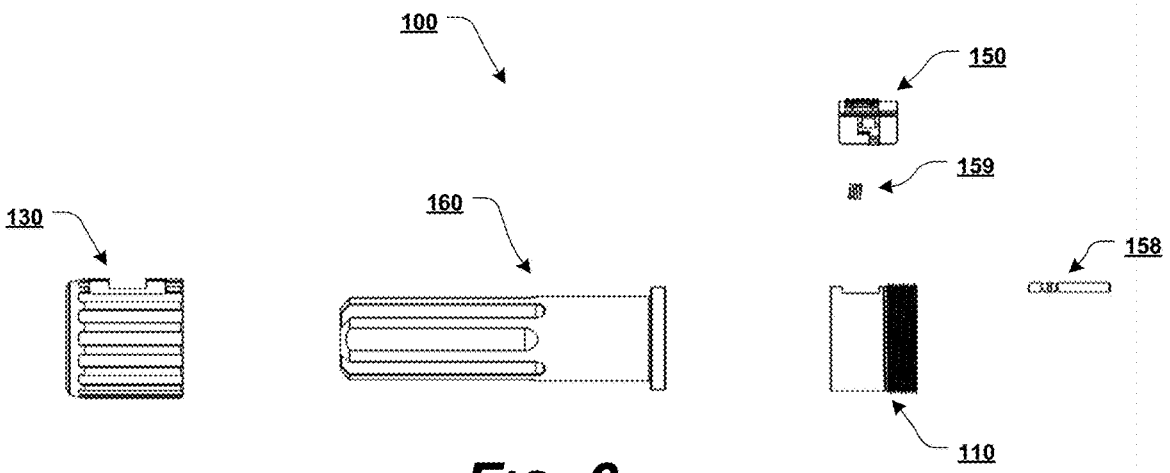
FIG. 6 illustrates an exploded, left side view of certain components of an exemplary embodiment of a muzzle device mounting system, according to the presently disclosed systems, methods, and/or apparatuses.
Figure 7:
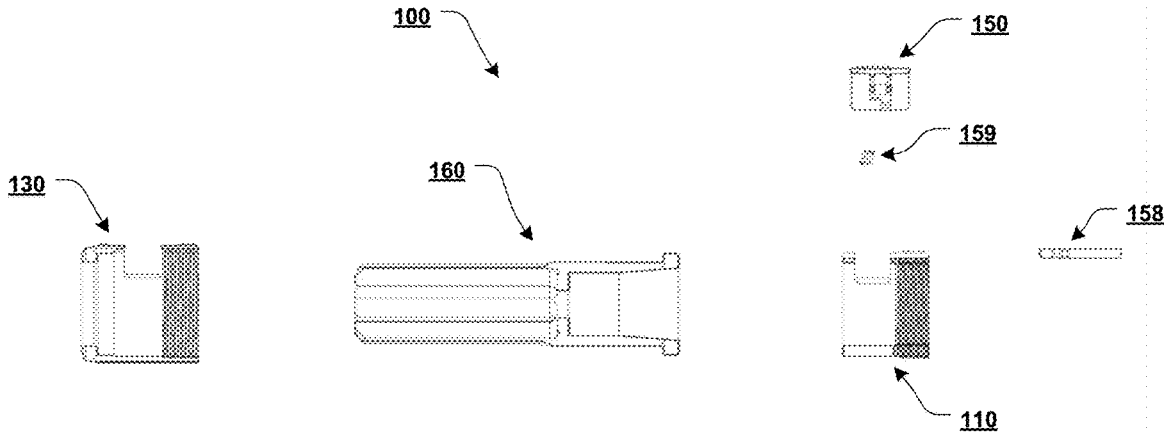
FIG. 7 illustrates an exploded, left side, cross-sectional view of certain components of an exemplary embodiment of a muzzle device mounting system, according to the presently disclosed systems, methods, and/or apparatuses.
Figure 8:
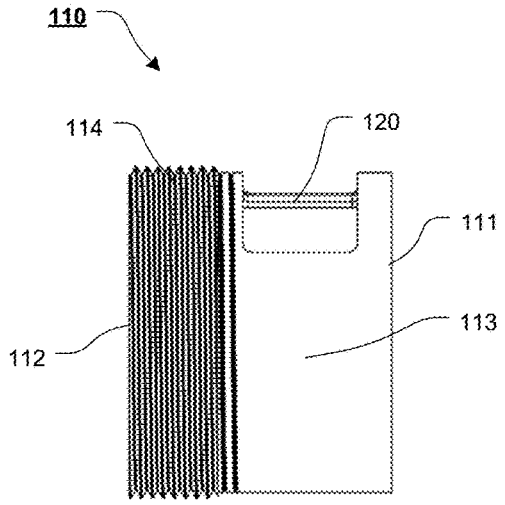
FIG. 8 illustrates a side view of an exemplary embodiment of an inner collar to be utilized as part of the muzzle device mounting system, according to the presently disclosed systems, methods, and/or apparatuses.
Figure 9:
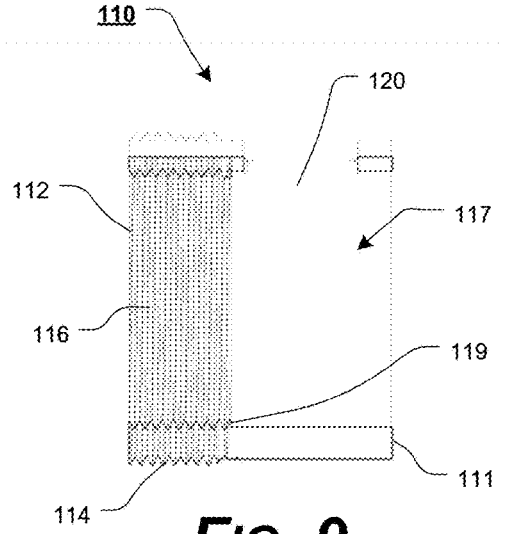
FIG. 9 illustrates a side cross-sectional view of an exemplary embodiment of an inner collar to be utilized as part of the muzzle device mounting system, according to the presently disclosed systems, methods, and/or apparatuses.
Figure 10:
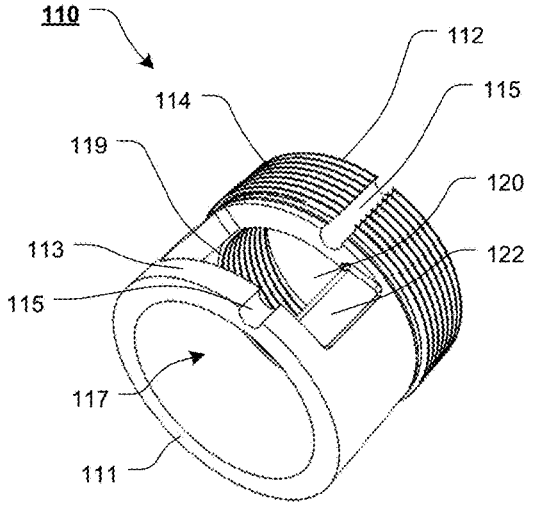
FIG. 10 illustrates a front perspective view of an exemplary embodiment of an inner collar to be utilized as part of the muzzle device mounting system, according to the presently disclosed systems, methods, and/or apparatuses.
Figure 11:
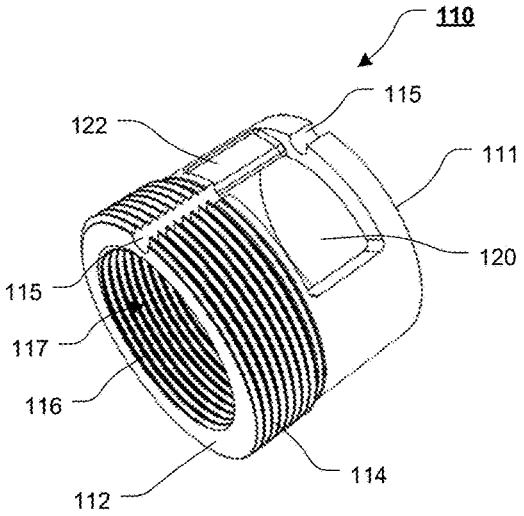
FIG. 11 illustrates a rear perspective view of an exemplary embodiment of an inner collar to be utilized as part of the muzzle device mounting system, according to the presently disclosed systems, methods, and/or apparatuses.
Figure 12:
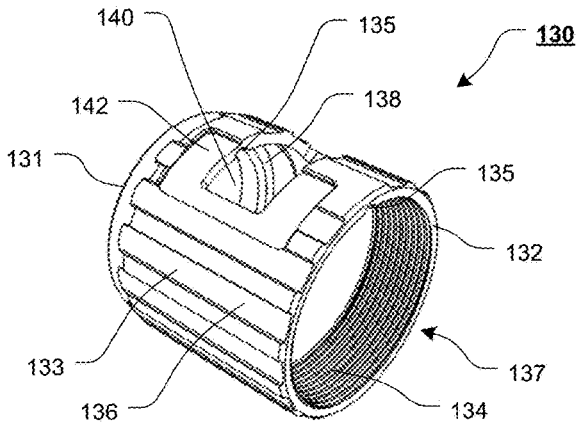
FIG. 12 illustrates a rear perspective view of an exemplary embodiment of an outer collar to be utilized as part of the muzzle device mounting system, according to the presently disclosed systems, methods, and/or apparatuses.
Figure 13:
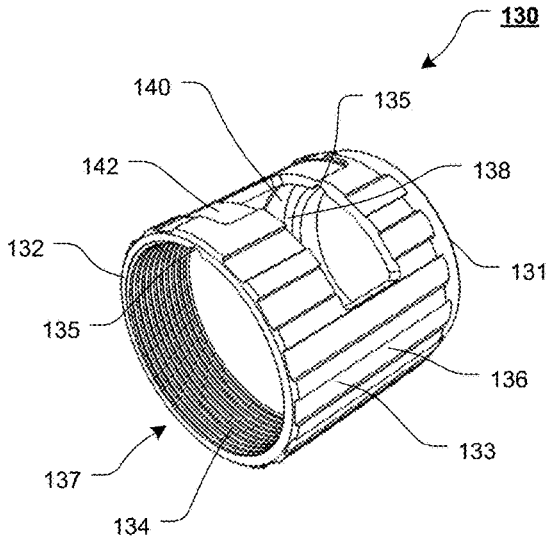
FIG. 13 illustrates a rear perspective view of an exemplary embodiment of an outer collar to be utilized as part of the muzzle device mounting system, according to the presently disclosed systems, methods, and/or apparatuses.
Figure 14:
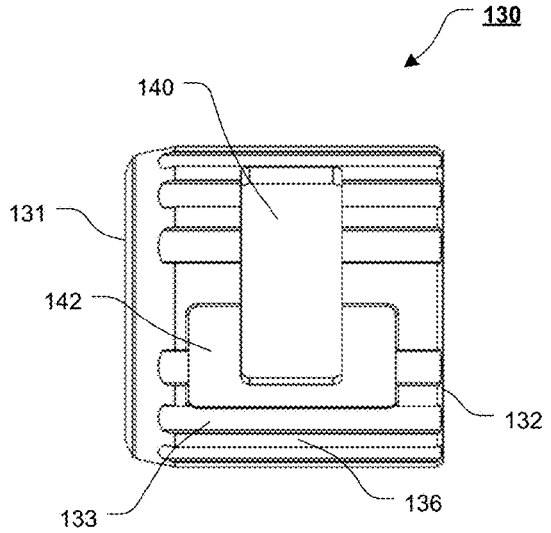
FIG. 14 illustrates a side view of an exemplary embodiment of an outer collar to be utilized as part of the muzzle device mounting system, according to the presently disclosed systems, methods, and/or apparatuses.
Figure 15:
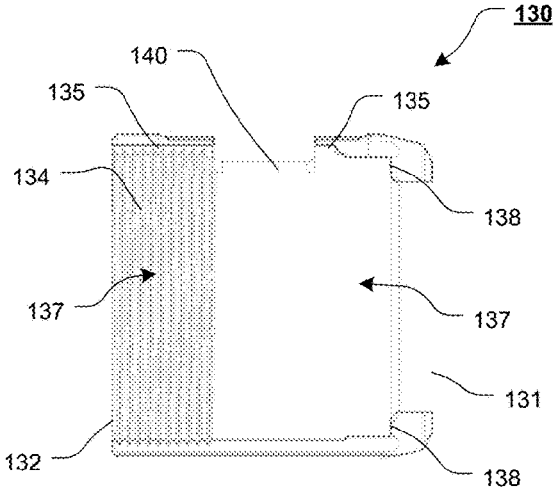
FIG. 15 illustrates a side, cross-sectional view of an exemplary embodiment of an outer collar to be utilized as part of the muzzle device mounting system, according to the presently disclosed systems, methods, and/or apparatuses.
Figure 16:
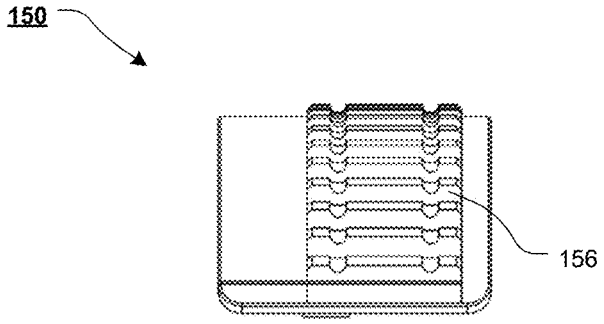
FIG. 16 illustrates a side view of an exemplary embodiment of a pawl lever to be utilized as part of the muzzle device mounting system, according to the presently disclosed systems, methods, and/or apparatuses.
Figure 17:
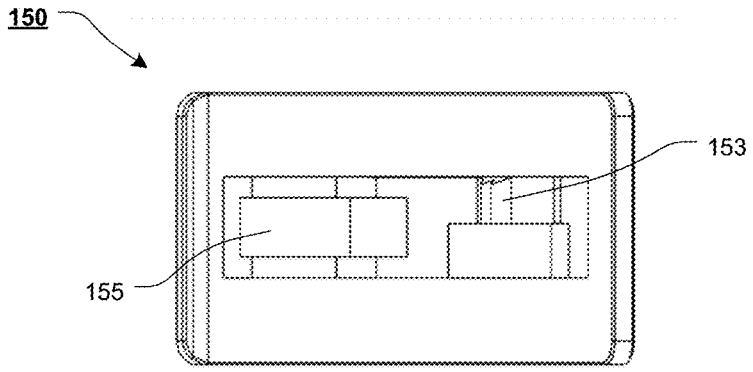
FIG. 17 illustrates a bottom view of an exemplary embodiment of a pawl lever to be utilized as part of the muzzle device mounting system, according to the presently disclosed systems, methods, and/or apparatuses.
Figure 18:
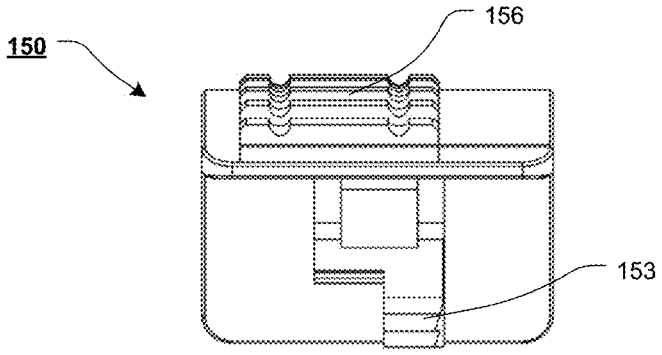
FIG. 18 illustrates a side view of an exemplary embodiment of a pawl lever to be utilized as part of the muzzle device mounting system, according to the presently disclosed systems, methods, and/or apparatuses.
Figure 19:
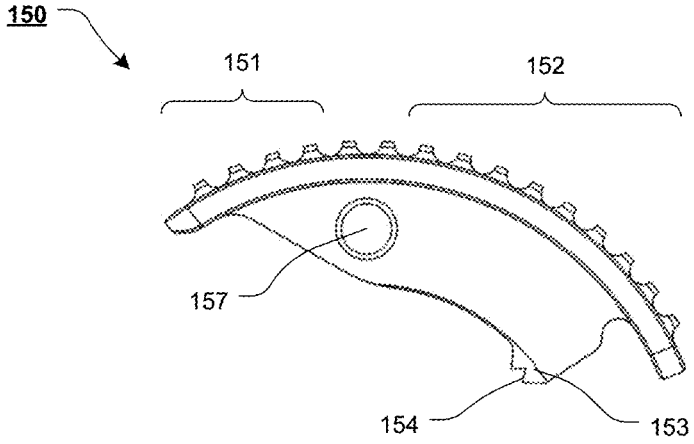
FIG. 19 illustrates a front view of an exemplary embodiment of a pawl lever to be utilized as part of the muzzle device mounting system, according to the presently disclosed systems, methods, and/or apparatuses.
Figure 20:
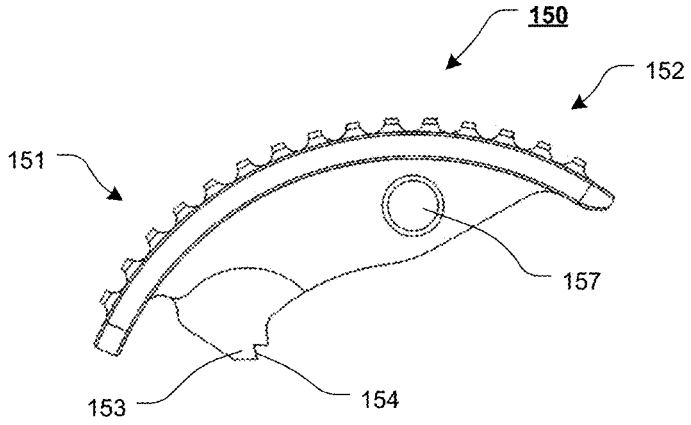
FIG. 20 illustrates a rear view of an exemplary embodiment of a pawl lever to be utilized as part of the muzzle device mounting system, according to the presently disclosed systems, methods, and/or apparatuses.
Figure 21:
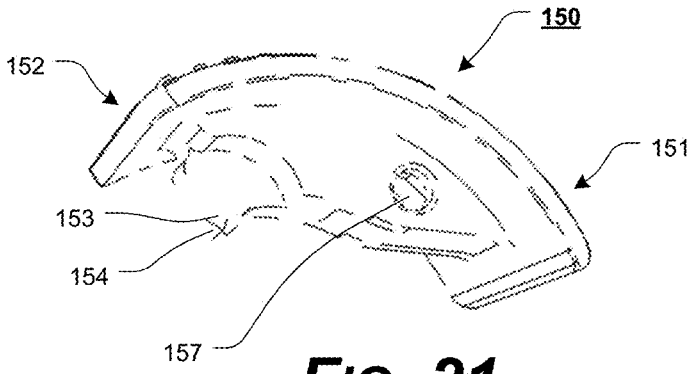
FIG. 21 illustrates a bottom perspective view of an exemplary embodiment of a pawl lever to be utilized as part of the muzzle device mounting system, according to the presently disclosed systems, methods, and/or apparatuses.
Figure 22:
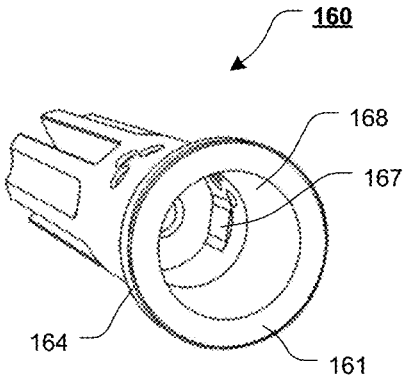
FIG. 22 illustrates a rear perspective view of an exemplary embodiment of a muzzle device to be utilized as part of the muzzle device mounting system, according to the presently disclosed systems, methods, and/or apparatuses.
Figure 23:
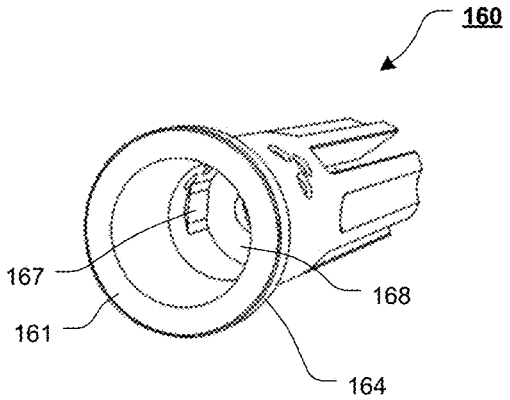
FIG. 23 illustrates a rear perspective view of an exemplary embodiment of a muzzle device to be utilized as part of the muzzle device mounting system, according to the presently disclosed systems, methods, and/or apparatuses.
Figure 24:
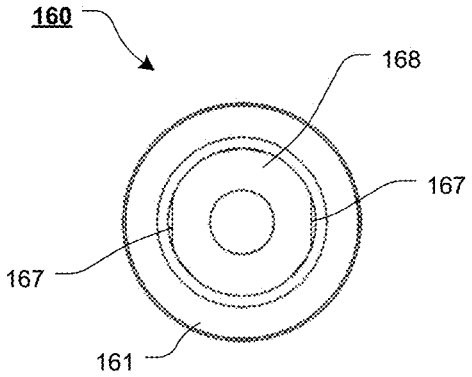
FIG. 24 illustrates a rear view of an exemplary embodiment of a muzzle device to be utilized as part of the muzzle device mounting system, according to the presently disclosed systems, methods, and/or apparatuses.
Figure 25:
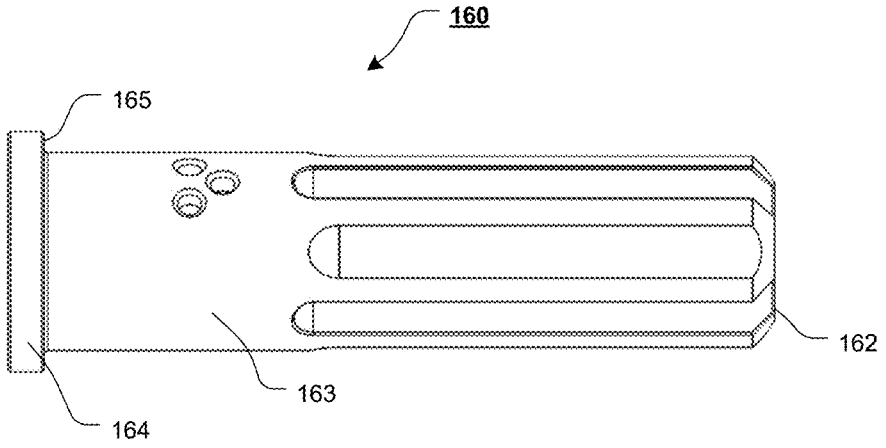
FIG. 25 illustrates a side view of an exemplary embodiment of a muzzle device to be utilized as part of the muzzle device mounting system, according to the presently disclosed systems, methods, and/or apparatuses.
Figure 26:
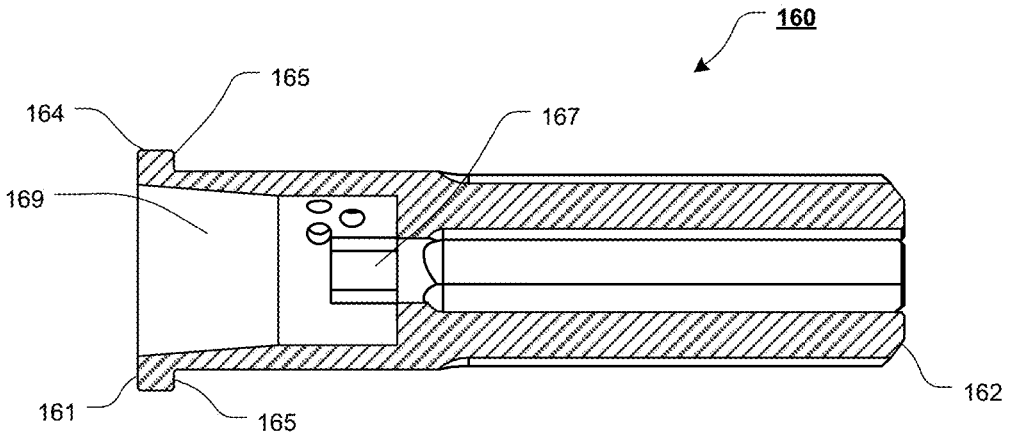
FIG. 26 illustrates a side, cross-sectional view of an exemplary embodiment of a muzzle device to be utilized as part of the muzzle device mounting system, according to the presently disclosed systems, methods, and/or apparatuses.
Figure 27:
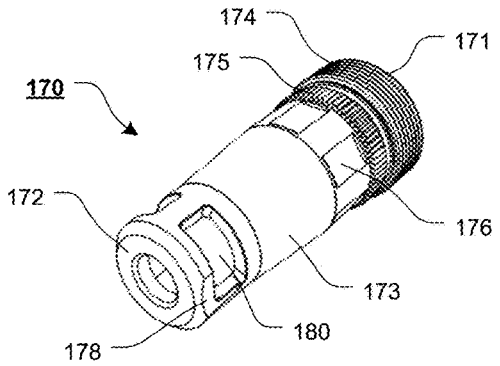
FIG. 27 illustrates a front perspective view of an exemplary embodiment of a muzzle adapter to be utilized as part of the muzzle device mounting system, according to the presently disclosed systems, methods, and/or apparatuses.
Figure 28:
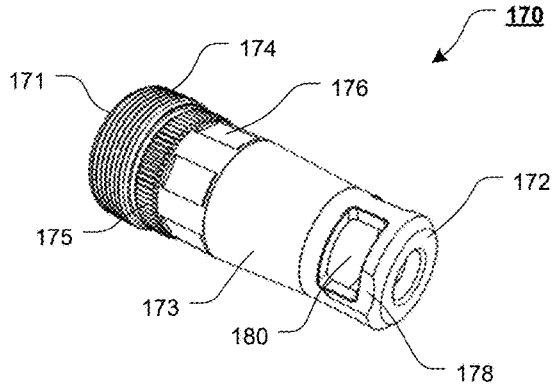
FIG. 28 illustrates a front perspective view of an exemplary embodiment of a muzzle adapter to be utilized as part of the muzzle device mounting system, according to the presently disclosed systems, methods, and/or apparatuses.
Figure 29:
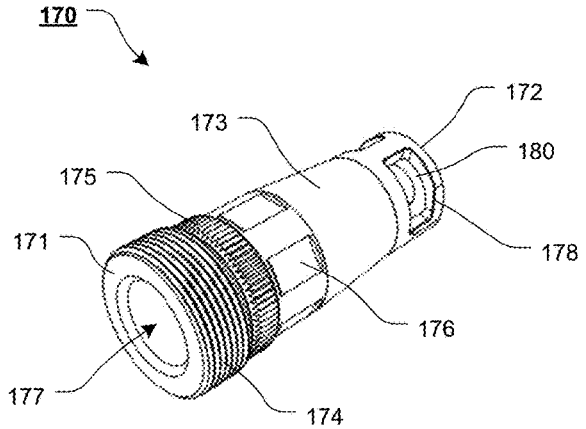
FIG. 29 illustrates a rear perspective view of an exemplary embodiment of a muzzle adapter to be utilized as part of the muzzle device mounting system, according to the presently disclosed systems, methods, and/or apparatuses.
Figure 30:
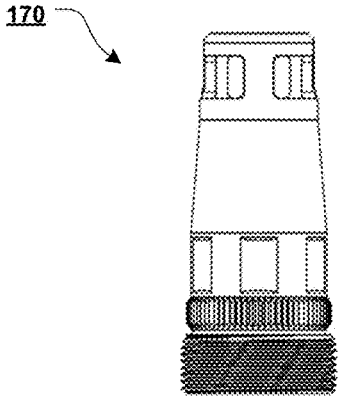
FIG. 30 illustrates a top perspective view of an exemplary embodiment of a muzzle adapter to be utilized as part of the muzzle device mounting system, according to the presently disclosed systems, methods, and/or apparatuses.
Figure 31:
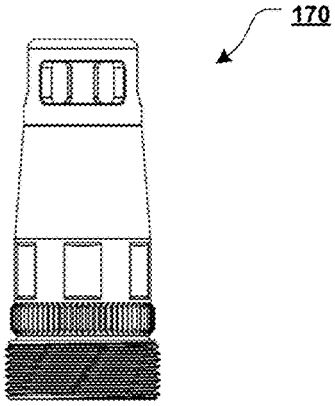
FIG. 31 illustrates a bottom perspective view of an exemplary embodiment of a muzzle adapter to be utilized as part of the muzzle device mounting system, according to the presently disclosed systems, methods, and/or apparatuses.
Figure 32:
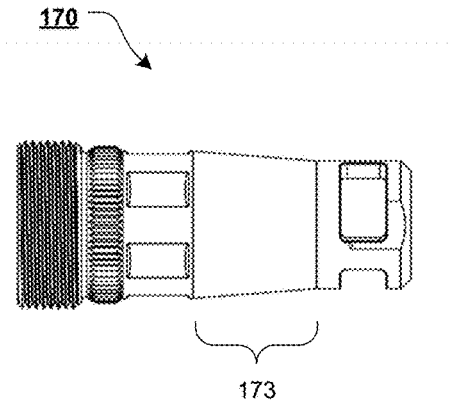
FIG. 32 illustrates a right side view of an exemplary embodiment of a muzzle adapter to be utilized as part of the muzzle device mounting system, according to the presently disclosed systems, methods, and/or apparatuses.

The foregoing and other objectives, features, and advantages of the invention will be more readily understood upon consideration of the following description of the invention taken in conjunction with the accompanying drawings.

For simplicity and clarification, the design factors and operating principles of the muzzle device mounting system according to the presently disclosed systems, methods, and/or apparatuses are explained with reference to various exemplary embodiments of a muzzle device mounting system according to the presently disclosed systems, methods, and/or apparatuses. The basic explanation of the design factors and operating principles of the muzzle device mounting system is applicable for the understanding, design, and operation of the muzzle device mounting system of the presently disclosed systems, methods, and/or apparatuses. It should be appreciated that the muzzle device mounting system can be adapted to many applications where a muzzle device mounting system can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "front" and "rear", "top" and "bottom", "upper" and "lower", and "horizontal" and "vertical" are used as a naming convention to arbitrarily distinguish between the exemplary embodiments and/or elements such terms describe. Thus, these terms are not necessarily intended to indicate temporal or other prioritization of such exemplary embodiments and/or elements, but are used to help differentiate between certain of the components of the present disclosure and are not to be construed as limiting the present disclosure.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

It should also be appreciated that the terms "muzzle device mounting system", "muzzle device", "muzzle adapter", "barrel", and "firearm" are used for basic explanation and understanding of the operation of the presently disclosed systems, methods, and/or apparatuses. Therefore, the terms "muzzle device mounting system", "muzzle device", "muzzle adapter", "barrel", and "firearm" are not to be construed as limiting the systems, methods, and/or apparatuses of the present disclosure. Thus, for example, the term "barrel" is to be understood to broadly include any length pistol or rifle barrel for a firearm or other similar handheld or shoulder mounted device or tool.

For simplicity and clarification, the muzzle device mounting system of the present disclosure will be described as being used in conjunction with a rifle barrel. However, it should be appreciated that these are merely exemplary embodiments of the muzzle device mounting system and are not to be construed as limiting the presently disclosed systems, methods, and/or apparatuses. Thus, the muzzle device mounting system of the present disclosure may be utilized in conjunction with any length firearm or other barrel.

Turning now to the drawing FIGS, FIG. 1-47 illustrate certain elements, components, and/or aspects of an exemplary embodiment of a muzzle device mounting system 100, according to the presently disclosed systems, methods, and/or apparatuses. In illustrative, non-limiting embodiment(s) of the present disclosure, the muzzle device mounting system 100 comprises at least some of a muzzle adapter 170, a muzzle device 160, an outer collar 130, an inner collar 110, a pawl lever 150, a pawl lever 150 tension element, and a pawl pin 158.

The muzzle device mounting system 100 allows a muzzle adapter 170 such as, for example, a micro compensator, to be attached or coupled to a firearm barrel 105. In various exemplary embodiments, the muzzle adapter 170 is permanently or semi-permanently attached or coupled to the barrel 105. The timing (or rotational alignment between the muzzle adapter 170 and the barrel 105) may optionally be adjusted by placement of shims between a shoulder of the barrel 105 and the barrel end 171 of the muzzle adapter 170. In various exemplary embodiments, and alignment notch 109 is formed in a portion of the barrel body 103, to act as a tactile or visual alignment aid for alignment or timing of the muzzle adapter 170 and the barrel 105.

The muzzle device mounting system 100 uses interaction of a conical taper portion 173 formed proximate the front or muzzle end 172 of the muzzle adapter 170 and a tapered recess portion 169 of a muzzle device 160 to assist in centering the muzzle device 160 relative to the muzzle adapter 170.

The conical taper portion 173 extends toward the barrel end 171 of the muzzle adapter 170. The outer diameter of the muzzle adapter 170 generally expands, along the conical taper portion 173, as the conical taper portion 173 extends toward the barrel end 171 of the muzzle adapter 170.

The muzzle adapter flats 178 formed on the muzzle adapter 170 may also optionally be aligned with muzzle device flats 167 formed within the muzzle device recess 168 of the muzzle device 160 for alignment of the muzzle device 160 with the muzzle adapter 170, such that the interaction of the muzzle device flats 167 with the muzzle adapter flats 178 stops the muzzle device 160 from rotating, relative to the muzzle adapter 170 and barrel 105, so that the muzzle device 160 can be perfectly "timed" with the barrel 105. The muzzle device 160 may be positioned at least partially within the collar assembly such that the muzzle device 160 can rotate but not come free, rendering the muzzle device 160 at least partially contained within the two part collar.

One or more muzzle adapter flats 178 are formed proximate the muzzle end 172 of the muzzle adapter 170. The muzzle adapter flats 178 are formed so as to be aligned with corresponding muzzle device flats 167 formed on the inside of a muzzle device 160 that is intended to be timed to the muzzle adapter 170, so that these muzzle devices 160 can be easily and repeatably aligned with the muzzle adapter 170.

A portion of the muzzle device recess 168 includes a muzzle device tapered recess portion 169. The muzzle adapter 170 also includes a conical taper portion 173. The tapered recess portion 169 and the conical taper portion 173 are formed so that the muzzle device 160 is auto centered as the muzzle adapter 170 is positioned within the muzzle device 160.

A collar assembly, comprising an inner collar 110 and an outer collar 130 is then utilized to pull the muzzle device 160 onto the muzzle adapter mounting surface.

As illustrated most clearly in FIGS. 8-11, the inner collar 110 comprises an inner collar body 113 extending from a first end 111 to a second end 112 and including inner collar aperture 117 formed therethrough. In various exemplary embodiments, the inner collar aperture 117 has a first inner diameter as the inner collar aperture 117 extends from the first end 111, toward the second end 112. An inner shoulder 119 is formed within the inner collar aperture 117 and the inner collar aperture 117 has a second, smaller, inner diameter as the inner collar aperture 117 extends from the inner shoulder 119 to the second end 112.

Inner collar threads 116 are formed within the inner collar aperture 117, extending from the inner shoulder 119, toward or to the second end 112 of the inner collar 110. The inner collar threads 116 are formed so as to be threadedly attached to the external muzzle adapter threads 174 of the muzzle adapter 170.

External collar threads 114 are formed, extending from the second end 112, toward first end 111.

A pawl lever aperture 120 is formed within a portion of the inner collar 110. The pawl lever aperture 120 is formed so as to allow at least a portion of the pawl lever 150 to be received therethrough, allowing potential interaction between the splines 175 of the muzzle adapter 170 and the pawl extension 153 of the pawl lever 150. A pawl lever notch 122 is formed proximate the pawl lever aperture 120 to allow at least a portion of the pawl lever 150 to be received at least partially therein.

An inner collar pin recess 115 extends along at least a portion of the inner collar body 113, extending from the second end 112 toward or to the first end 111. When the pawl pin 158 is at least partially received within at least a portion of the aligned inner collar pin recess 115 and outer collar pin recess 135, and pawl pin 158 acts to maintain the inner collar 110 in a fixed rotational position relative to the outer collar 130.

As illustrated most clearly in FIGS. 12-15, the outer collar 130 comprises an outer collar body 133 extending from a first end 131 to a second end 132 and including an outer collar aperture 137 formed therethrough. In various exemplary embodiments, the outer collar aperture 137 has a first inner diameter as the outer collar aperture 137 extends from the second end 132, toward the first end 131, to an outer collar shoulder 138. The outer collar shoulder 138 is formed within the outer collar aperture 137 and the outer collar aperture 137 has a second, smaller, inner diameter as the outer collar aperture 137 extends from the outer collar shoulder 138 to the first end 131. Typically, the first inner diameter is formed so as to allow at least a portion of a muzzle device capture ring 164 to be received therein. The outer collar shoulder 138 is formed so as to engage the muzzle device shoulder 165 of the muzzle device 160 and maintain the muzzle device capture ring 164 within the outer collar aperture 137.

In various exemplary embodiments, the inner diameter of the outer collar aperture 137 is substantially constant as the outer collar aperture 137 extends from the first end 131 to the inner collar shoulder.

Thus, the outer collar aperture 137 extends from the second end 132 to an outer collar shoulder 138, to an inner collar shoulder, and from the inner collar shoulder to the first end 131.

The second inner diameter is formed so as to allow at least a portion of the muzzle device capture ring 164 to be maintained within the outer collar aperture 137. Thus, the outer collar 130 can be rotated relative to the muzzle device 160, while the muzzle device capture ring 164 is maintained within the outer collar aperture 137, with at least a portion of the inner collar shoulder abutted against the muzzle device shoulder 165.

Outer collar internal threads 134 are formed, extending from the second end 132, toward or to the outer collar shoulder 138. The outer collar internal threads 134 are formed so as to interact with the external collar threads 114 of the inner collar 110.

In various exemplary embodiments, the outer collar body 133 has texturing 136 or other surface preparations (such as, for example, spaced apart, parallel recesses) formed along at least a portion of the surface of the outer collar body 133. The texturing 136, if included, allows for increased gripping of the outer surface of the outer collar body 133 for rotational movement of the outer collar body 133. In various exemplary embodiments, the outer collar body 133 may be formed so as to allow a wrench or other device to grip the least a portion of the outer collar 130 for increased rotational torque.

As illustrated most clearly in FIGS. 22-26, the muzzle device 160 extends from a first end 161 to a second end 162. A muzzle device capture ring 164, comprising a portion of the muzzle device body 163 having an extended outer diameter, extends from the first end 161, toward the second end 162, and terminating in a muzzle device shoulder 165.

A muzzle device recess 168 extends from the first end 161 of the muzzle device 160. A portion of the muzzle device recess 168 includes a muzzle device tapered recess portion 169. The muzzle adapter 170 also includes a conical taper portion 173. The tapered recess portion 169 and the conical taper portion 173 are formed so that the muzzle device 160 is auto centered as the muzzle adapter 170 is positioned within the muzzle device 160.

In various exemplary, nonlimiting embodiments, muzzle device flats 167 are optionally formed within the muzzle device recess 168 of the muzzle device 160 for alignment of the muzzle device 160 with the muzzle adapter 170, such that the interaction of the muzzle device flats 167 with the muzzle adapter flats 178 stops the muzzle device 160 from rotating, relative to the muzzle adapter 170 and barrel 105, so that the muzzle device 160 can be perfectly "timed" with the barrel 105. The muzzle device 160 may be positioned at least partially within the collar assembly such that the muzzle device 160 can rotate but not come free, rendering the muzzle device 160 at least partially contained within the two part collar.

While the muzzle device 160 is illustrated as comprising a flash hider, it should be appreciated that the muzzle device 160 may comprise a muzzle brake, a flash hider, a compensator, a hybrid muzzle device, or the like.

Figure 33:
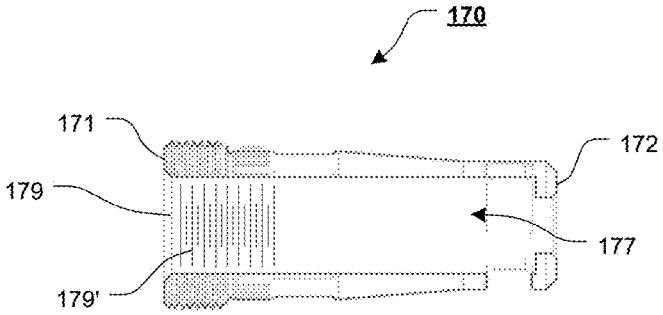
FIG. 33 illustrates a right side, cross-sectional view of an exemplary embodiment of a muzzle adapter to be utilized as part of the muzzle device mounting system, according to the presently disclosed systems, methods, and/or apparatuses.
Figure 37:
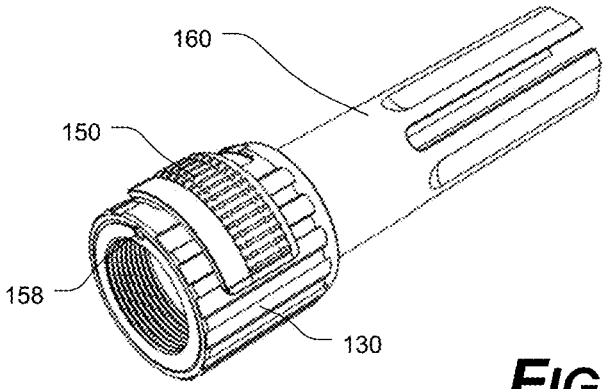
FIG. 37 illustrates a rear perspective view of an exemplary embodiment of certain of the elements to be utilized as part of the muzzle device mounting system, according to the presently disclosed systems, methods, and/or apparatuses.

As illustrated most clearly in FIGS. 37-33, the muzzle adapter 170 comprises a muzzle adapter aperture 177 extending from the barrel end 171 to the muzzle end 172. A threaded aperture portion 179' extends from the barrel end 171 through at least a portion of the muzzle adapter aperture 177.

Muzzle adapter threads 174 are formed within the threaded aperture portion 179' of the muzzle adapter aperture 177. The muzzle adapter threads 174 are formed so as to be threadedly attached to the external muzzle threads 108 of the threaded muzzle device attachment area of the barrel 105.

Figure 34:
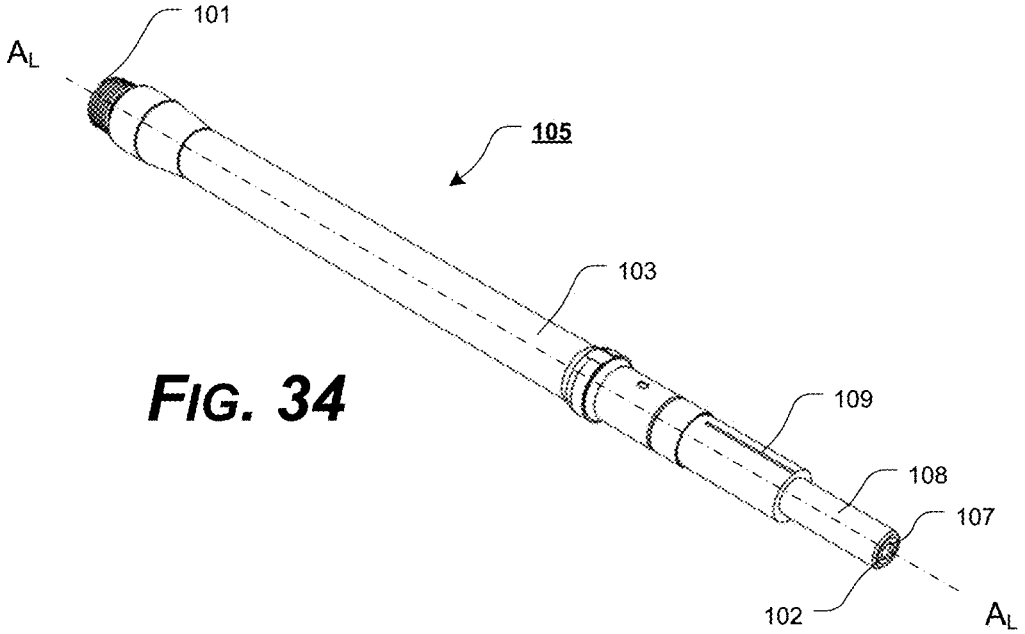
FIG. 34 illustrates a front perspective view of an exemplary embodiment of a barrel to be utilized as part of the muzzle device mounting system, according to the presently disclosed systems, methods, and/or apparatuses.
Figure 35:
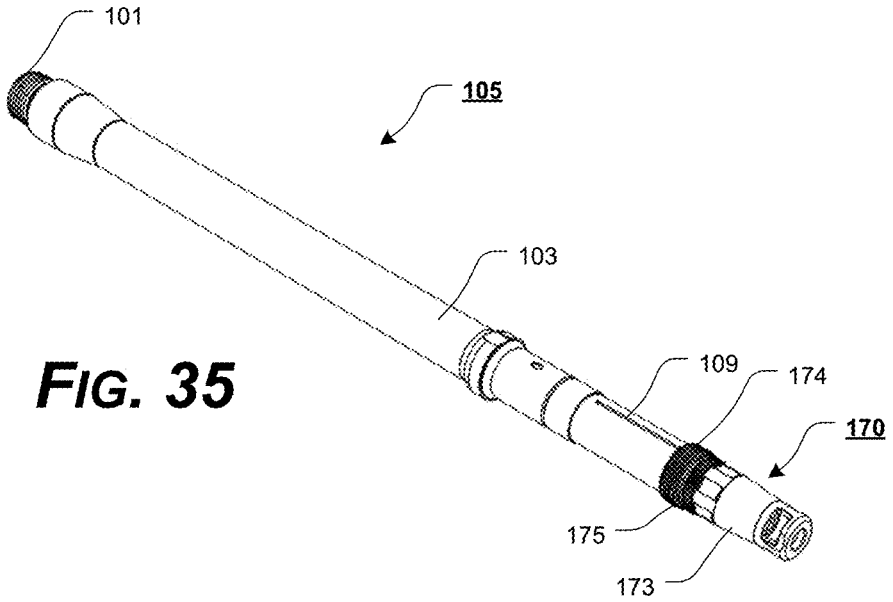
FIG. 35 illustrates a front perspective view of an exemplary embodiment of a barrel having a muzzle adapter attached or coupled to the barrel, according to the presently disclosed systems, methods, and/or apparatuses.
Figure 36:
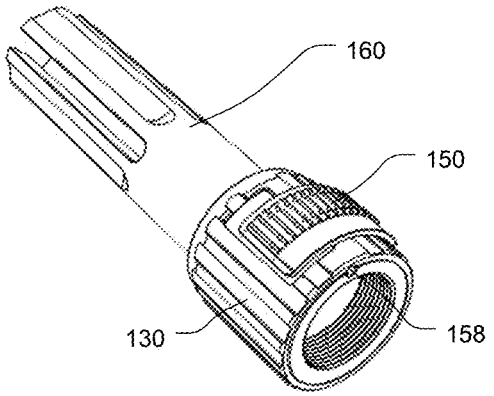
FIG. 36 illustrates a rear perspective view of an exemplary embodiment of certain of the elements to be utilized as part of the muzzle device mounting system, according to the presently disclosed systems, methods, and/or apparatuses.

During installation of the muzzle adapter 170 on the barrel 105, as illustrated most clearly in FIGS. 34-35, the barrel 105 is aligned with the initial aperture portion 179 of the muzzle adapter 170 and the internal threads of the threaded aperture portion 179' of the muzzle adapter 170 interact with the external muzzle threads 108 of the threaded muzzle device attachment area of the barrel 105 to secure the muzzle adapter 170 to the barrel 105. When appropriately secured, the barrel end 171 of the muzzle adapter 170 may optionally be abutted against the muzzle device shoulder 165 of the barrel 105.

The muzzle adapter 170 is threadedly attached or coupled to the barrel 105 and may optionally be timed to the barrel 105 using the timing shims. The muzzle adapter 170 can be further attached or coupled with rocksett or a similar thread locker.

In certain exemplary embodiments, during installation, one or more timing shims may be positioned around the threaded muzzle device attachment area, between the barrel end 171 of the muzzle adapter 170 and the barrel projection shoulder. As a muzzle device 160 is rotationally installed on the barrel 105, the one or more timing shims may be abutted between the barrel end 171 of the muzzle adapter 170 and the muzzle device shoulder 165 of the barrel 105. By including one or more timing shims, if needed, the rotational position of the muzzle adapter 170, relative to the barrel 105, may be controlled and the muzzle adapter 170 may be torqued to a desired specification.

Figure 46:
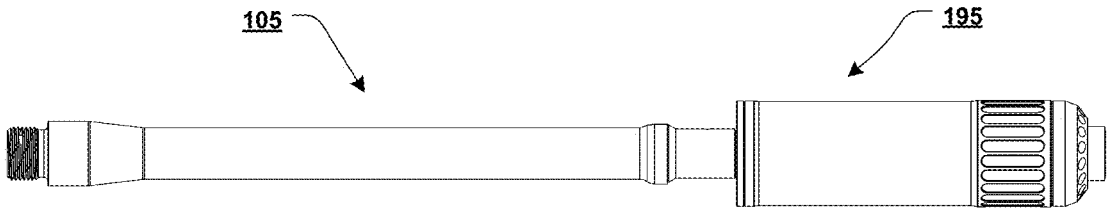
FIG. 46 illustrates a side view of an exemplary embodiment of an over barrel suppressor mounted to a barrel utilizing the muzzle device mounting system, according to the presently disclosed systems, methods, and/or apparatuses.
Figure 47:
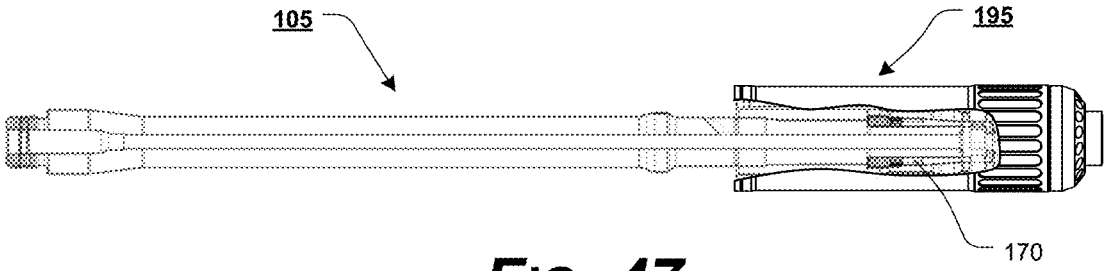
FIG. 47 illustrates a side, partial cross-sectional view of an exemplary embodiment of an over barrel suppressor mounted to a barrel utilizing the muzzle device mounting system, according to the presently disclosed systems, methods, and/or apparatuses.

In certain exemplary embodiments, as illustrated, for example, in FIGS. 46-47, a suppressor 195 or other device may be attached or coupled to the muzzle adapter 170.

As illustrated, the spring-loaded pawl lever 150 interacts with the spaced apart grooves or splines 175 formed around the exterior portion of the muzzle adapter 170. A plurality of splines 175 or notches are formed at spaced apart locations around the muzzle adapter 170 proximate the muzzle adapter threads 174, toward the barrel end 171 of the muzzle adapter 170. The splines 175 in the muzzle adapter 170 allow the pawl lever 150 engagement services or other type of ratchet to lock the rotation of the outer collar 130 relative to the inner collar 110. In various exemplary embodiments, each spline 175 is an elongate spline 175 or notch, along the longitudinal axis of the muzzle adapter 170.

One or more muzzle adapter ports 180 or apertures formed in the muzzle adapter 170 also align with any apertures, ports, or holes in the muzzle device 160 so that muzzle rise control can still be used through both the muzzle adapter 170 and the muzzle device 160.

The ratchet collar includes a pawl lever 150, pawl tension element 159, and pawl pin 158. There are two portions of the collar that screw together until the respective second ends 112 and 132 of the inner collar 110 and outer collar 130 or substantially flush with one another and a hole is formed between the inner collar 110 (providing an inner collar pin recess 115) and outer collar 130 (providing an outer collar pin recess 135) that a pawl pin 158 can slide into.

As illustrated, the pawl lever 150 is pivotably attached, via the pawl pin 158, positioned through a pawl pin aperture 157 of the pawl lever 150 and the aligned inner collar pin recess 115 of the inner collar 110 and the outer collar pin recess 135 of the outer collar 130. The pawl tension element 159 biases the pawl lever 150 to a closed or engaged position, within which a pawl extension 153 extends to contact ratchet style splines 175 formed at spaced apart locations around the muzzle adapter 170.

Once positioned, the pawl pin 158 acts as a key between the inner collar 110 and outer collar 130 that stops the inner collar 110 and outer collar 130 from rotating relative to one another or from coming undone. The pawl pin 158 may optionally be spot welded or otherwise affixed in place so that the pawl pin 158 cannot fall out. The two collar portions are now held together with the pawl pin 158 that also captures the pawl and pawl tension element 159.

The pawl is spring biased to a locked position by a pawl tension element 159, such as, for example, a coiled spring, which is retained in a pawl tension element recess 155 in the pawl lever 150 around the pawl pin 158. One leg of the pawl tension element 159 forms a flat area that registers with two notches on the pawl pin 158 (similar to how the auto sear spring works in a M4/M16). The pawl tension element 159 and notched pawl pin 158 allow the pawl lever 150 to be slid backwards and forwards in an engaged and disengaged position.

Figure 44:
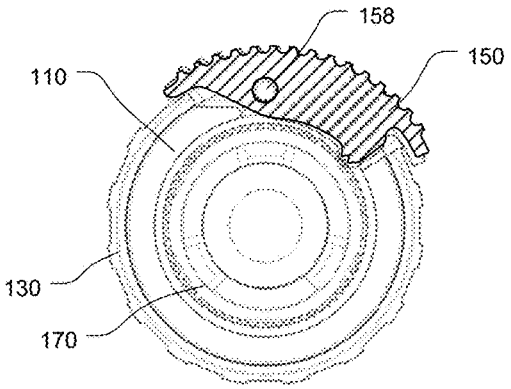
FIG. 44 illustrates a rear, cross-sectional view of an exemplary embodiment of the muzzle device mounting system, wherein the pawl lever is in the disengaged position, according to the presently disclosed systems, methods, and/or apparatuses.
Figure 45:
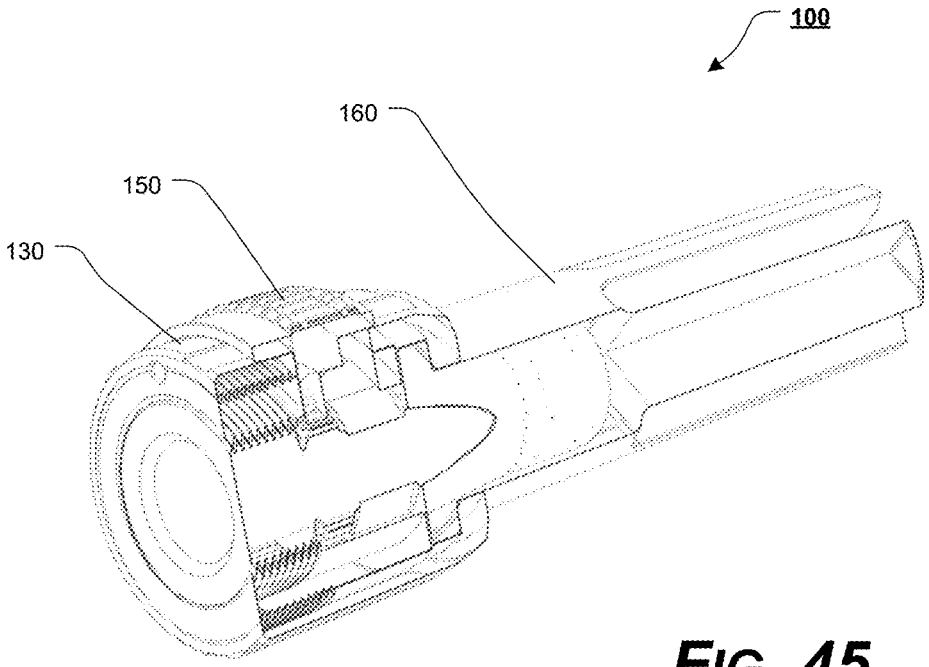
FIG. 45 illustrates a rear, perspective, cross-sectional view of an exemplary embodiment of the muzzle device mounting system, wherein the pawl lever is in the engaged position, according to the presently disclosed systems, methods, and/or apparatuses.

When a finger button portion 151 of the pawl lever 150 is depressed and the spring bias of the pawl tension element 159 is overcome, the pawl lever 150 is pivoted to a disengaged position, as illustrated in, for example, FIG. 44, wherein the pawl extension 153 is withdrawn from the splines 175. When the finger button portion 151 is released, the spring bias of the pawl tension element 159 rotates the pawl lever 150 to the engaged position, as illustrated in, for example, FIG. 43.

The muzzle device mounting system 100 comprises a pawl lever 150 that is capable of restricting rotational movement of the outer collar 130 relative to the inner collar 110, at least in one rotational direction (i.e., restricting clockwise or restricting counterclockwise rotation of the outer collar 130 relative to the inner collar 110), while permitting a quick release of the pawl lever 150. The pawl lever 150 comprises at least some of a finger button portion 151 and an engagement portion 152.

In various exemplary embodiments, the first side of at least the finger button portion 151 includes a textured portion 156. In this manner, the finger button portion 151 may be distinguished tactilely from other portions of the pawl lever 150 of the muzzle device mounting system 100.

In various exemplary, non-limiting embodiments, pawl lever 150 is pivotally attached or coupled, between the outer collar 130 and the inner collar 110, approximately between the finger button portion 151 and the engagement portion 152, via a fulcrum or pawl pin 158. In various exemplary embodiments, the pawl pin 158 is positioned substantially parallel to the longitudinal axis of the muzzle device mounting system 100, substantially perpendicular to a longitudinal axis of the muzzle device mounting system 100, at a substantially acute angle relative to a longitudinal axis of the muzzle device mounting system 100, or at a substantially obtuse angle relative to a longitudinal axis of the muzzle device mounting system 100. Thus, the pawl pin 158 may be positioned at any angle relative to a longitudinal axis of the muzzle device mounting system 100.

The pawl lever 150 is positioned at least partially within a pawl lever aperture 120 of the inner collar 110 and is pivotable between an engaged position for at least partially restricting rotational movement of the muzzle device mounting system 100 relative to the barrel 105 and a disengaged position for unrestricted rotational movement of the muzzle device mounting system 100 relative to the barrel 105.

In various exemplary embodiments, the pawl lever 150 is biased to the engaged position. In various exemplary embodiments, biasing of the pawl lever 150 may be accomplished by, for example, a pawl tension element 159.

The engagement portion 152 of the pawl lever 150 includes a pawl extension 153. In various exemplary, non-limiting embodiments, the pawl extension 153 includes a ramp surface and an engagement surface 154.

When the pawl lever 150 is in the engaged position, the pawl extension 153 protrudes from the second side of the engagement portion 152, into at least a portion of the inner collar aperture 117 formed in the inner collar 110, via the pawl lever aperture 120 in the inner collar 110. In this manner, the pawl extension 153 may extend inside the inner collar aperture 117 and the engagement surface 154 may engage one or more splines 175 of a muzzle adapter 170 that is positioned at least partially within the inner collar aperture 117, thereby inhibiting or restricting rotational movement of the outer collar 130 relative to the inner collar 110.

If the pawl lever 150 is urged or positioned rearward (toward the barrel 105 of the firearm), the pawl lever 150 is engaged and the engagement surface 154 of the pawl lever 150 is over the raised teeth or splines 175 of the muzzle adapter 170. If the pawl lever 150 is urged or positioned forward (away from the barrel 105 of the firearm), the pawl lever 150 is disengaged and the engagement surface 154 of the pawl lever 150 is over the smooth section on the mount.

When disengaged, the pawl lever 150 cannot stop the outer collar 130 from rotating relative to the inner collar 110, making it possible for the muzzle device 160 to be removed, when the pawl lever 150 is in the engaged position, the engagement surface 154 of the pawl lever 150 stops rotation by binding with the radial teeth or splines 175 on the mount.

The outer collar 130 has a relief cut that allows the pawl button to rotate in one direction only.

The system allows an over barrel suppressor 195 to be fitted to the same conical surface and threads reducing point of impact shift from one device to the next. The pawl lever 150 can be disengaged making it easier for the user to grab the collar and remove any devices that have become stuck in place.

As illustrated most clearly in FIGS. 34-35, the barrel 105 comprises an elongate barrel 105 having a barrel body 103 and extending, along a longitudinal axis, $A_L$, from a chamber end 101 to a muzzle end 102. A barrel borehole 107 is formed through the barrel body 103, along the longitudinal axis.

It should be appreciated that the barrel 105 may be a rifle barrel, a pistol barrel, or any other small or large caliber operable, toy, or replica firearm, artillery, or other barrel.

The barrel 105 includes a threaded portion having muzzle threads 108 that extend from the muzzle end 102 of the barrel 105, toward the chamber end 101 of the barrel 105. In various exemplary embodiments, the muzzle threads 108 are similar to known muzzle threads included on a standard barrel.

The various components of the muzzle device mounting system 100 are fitted together and the muzzle device mounting system 100 is attached or coupled to an exemplary barrel 105. As illustrated, during assembly of the muzzle device mounting system 100, the first end 161 of the muzzle device 160 is abutted against the first end 111 of the inner collar 110. The second end 162 of the muzzle device 160 is then urged through the outer collar aperture 137 of the outer collar 130 until the muzzle device shoulder 165 contacts the outer collar shoulder 138. As the second end 162 of the muzzle device 160 is urged through the outer collar aperture 137, the outer collar internal threads 134 interact with the inner collar external threads to allow the outer collar 130 to be secured to the inner collar 110.

The outer collar 130 and inner collar 110 are rotated relative to one another (via the outer collar internal threads 134 and the external collar threads 114) until the respective second end 112 of the inner collar 110 and second end 132 of the outer collar 130 are substantially flush with one another and the inner collar pin recess 115 and the outer collar pin recess 135 are aligned to form an aperture between the inner collar 110 and the outer collar 130. The pawl pin 158 is then urged from the second end 132 of the aligned outer collar 130 and inner collar 110, toward the first end 111. When the pawl pin 158 is urged a sufficient distance to reach the aligned pawl lever aperture 120 of the inner collar 110 and pawl lever aperture 140 of the outer collar 130, the pawl tension element 159 is positioned within at least a portion of the pawl tension element recess 155 of the pawl lever 150 and the pawl lever 150 is appropriately positioned such that the pawl pin 158 is urged through the pivot pin aperture 157 of the pawl lever 150 and further through the aligned outer collar 130 and inner collar 110, toward the first end 111. A pawl lever notch 142 is formed proximate the pawl lever aperture 140 to allow at least a portion of the pawl lever 150 to be received at least partially therein.

Thus, the outer collar 130, inner collar 110, muzzle device 160, pawl lever 150, pawl pin 158, and pawl tension element 159 are secured together to form the muzzle device mounting system 100. Once appropriately assembled, the muzzle device 160 is able to rotate relative to the outer collar 130 and inner collar 110.

As illustrated, the pawl lever 150 is pivotably attached, via the pawl pin 158, positioned through a pawl pin aperture 157 of the pawl lever 150 and the aligned inner collar pin recess 115 of the inner collar 110 and the outer collar pin recess 135 of the outer collar 130. The pawl tension element 159 biases the pawl lever 150 to a closed or engaged position, within which a pawl extension 153 extends to contact ratchet style splines 175 formed at spaced apart locations around the muzzle adapter 170.

Once positioned, the pawl pin 158 acts as a key between the inner collar 110 and outer collar 130 that stops the inner collar 110 and outer collar 130 from rotating relative to one another or from coming undone. The pawl pin 158 may optionally be spot welded or otherwise affixed in place so that the pawl pin 158 cannot fall out. The two collar portions are now held together with the pawl pin 158 that also captures the pawl and pawl tension element 159.

The assembled muzzle device mounting system 100 may then be removably attached or coupled to the muzzle adapter 170. During attachment, the muzzle end 172 of the muzzle adapter 170 is aligned with and urged through the inner collar aperture 117 of the inner collar 110. As the muzzle end 172 of the muzzle adapter 170 is urged through the inner collar aperture 117 of the inner collar 110, the inner collar threads of the inner collar 110 interact with the external muzzle adapter threads 174 to secure the muzzle device mounting system 100 to the muzzle adapter 170.

As the muzzle end 172 of the muzzle adapter 170 is urged into the muzzle device mounting system 100, the engagement surface 154 of the pawl lever 150 contacts and interacts with the splines 175 of the muzzle adapter 170.

In various exemplary embodiments, as the engagement surface 154 interacts with the splines 175 of the muzzle adapter 170, the spring bias of the pawl tension element 159 may be overcome, and the pawl extension 153 is urged from the inner collar aperture 117 until the pawl extension 153 contacts a spline 175 of the barrel 105. Alternatively, the spring bias of the pawl tension element 159 may be such that the pawl lever 150 must be pivoted to the release position before the engagement surface 154 of the pawl lever 150 allows the splines 175 to pass the engagement surface 154.

As the inner collar threads of the inner collar 110 contact the adapter threads 174 of the muzzle adapter 170, rotational movement of the combined inner collar 110 and outer collar 130 allows the inner collar threads to interact with the adapter threads 174 of the muzzle adapter 170 to attach the muzzle device mounting system 100 to the muzzle adapter 170. As the muzzle device mounting system 100 is threaded the attached to the muzzle adapter 170, interaction between the engagement surface 154 of the pawl extension 153 and the spaced apart splines 175 counteracts rotational forces of the muzzle device mounting system 100 relative to the muzzle adapter 170.

To aid in the installation of the muzzle adapter 170, parallel mounting flats 176 may be provided on either side of the muzzle adapter 170. The mounting flats 176 provide parallel surfaces for a wrench or other installation device to grip the muzzle adapter 170.

Figure 38:
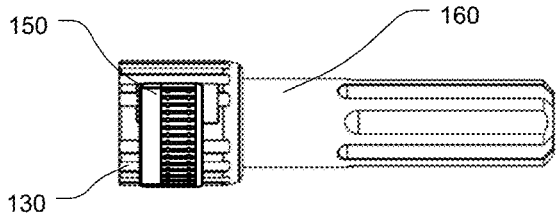
FIG. 38 illustrates a side view of an exemplary embodiment of certain of the elements to be utilized as part of the muzzle device mounting system, wherein the pawl lever is in the engaged position, according to the presently disclosed systems, methods, and/or apparatuses.
Figure 39:
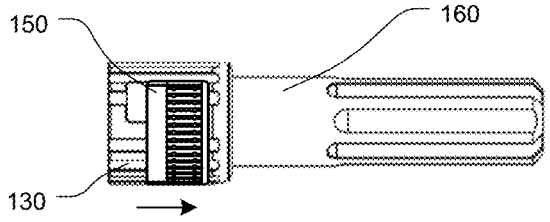
FIG. 39 illustrates a side view of an exemplary embodiment of certain of the elements to be utilized as part of the muzzle device mounting system, wherein the pawl lever is in the disengaged position, according to the presently disclosed systems, methods, and/or apparatuses.
Figure 40:
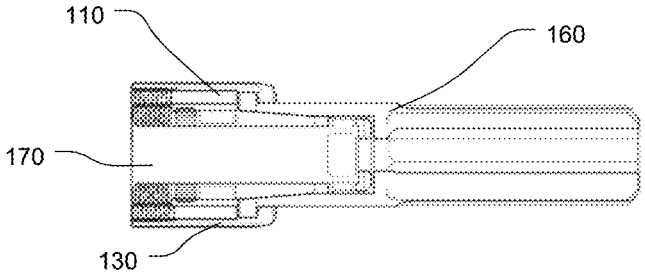
FIG. 40 illustrates a side, cross-sectional view of an exemplary embodiment of certain of the elements to be utilized as part of the muzzle device mounting system, according to the presently disclosed systems, methods, and/or apparatuses.
Figure 41:
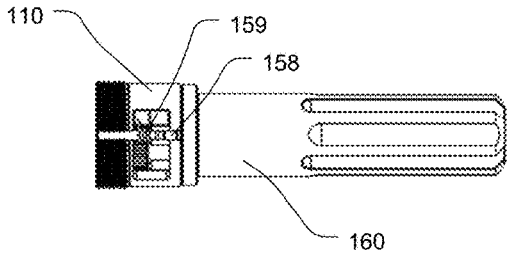
FIG. 41 illustrates a side view of an exemplary embodiment of certain of the elements to be utilized as part of the muzzle device mounting system, according to the presently disclosed systems, methods, and/or apparatuses.
Figure 42:
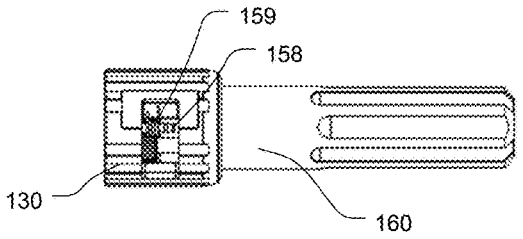
FIG. 42 illustrates a side view of an exemplary embodiment of certain of the elements to be utilized as part of the muzzle device mounting system, according to the presently disclosed systems, methods, and/or apparatuses.
Figure 43:
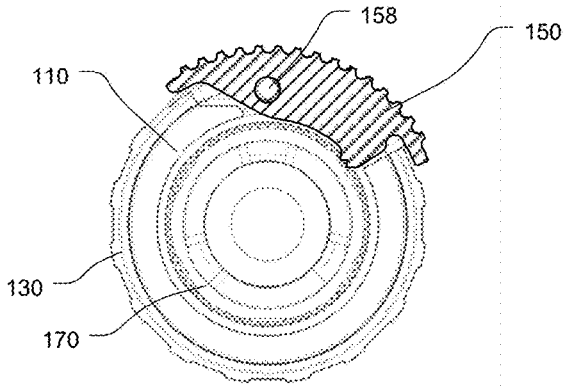
FIG. 43 illustrates a rear, cross-sectional view of an exemplary embodiment of the muzzle device mounting system, wherein the pawl lever is in the engaged position, according to the presently disclosed systems, methods, and/or apparatuses.

To remove the muzzle device mounting system 100, the pawl lever 150 may be urged from the engaged position, as illustrated in FIG. 38, to the disengaged position, as illustrated in FIG. 39.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A muzzle device mounting system, comprising:

an outer collar;

an inner collar attached or coupled to said outer collar, wherein said outer collar is in a fixed rotational position relative to said inner collar;

a muzzle device positioned at least partially between said inner collar and said outer collar, wherein said muzzle device is rotatable relative to said outer collar and said inner collar; and a pawl lever pivotably positioned relative to said outer collar and said inner collar, wherein said pawl lever includes an engagement surface for engaging one or more splines of a muzzle adapter, and wherein said pawl lever is slidable relative to said outer collar and said inner collar along a longitudinal axis of said outer collar and said inner collar.

2. The muzzle device mounting system of claim 1, wherein said muzzle adapter is formed so as to be at least partially fitted within an inner collar aperture of said inner collar.

3. The muzzle device mounting system of claim 1, wherein said one or more splines are formed at spaced apart locations around at least a portion of said muzzle adapter.

4. The muzzle device mounting system of claim 1, wherein a conical taper portion is formed in at least a portion of said muzzle adapter.

5. The muzzle device mounting system of claim 1, wherein a muzzle device tapered recessed portion is formed within at least a portion of said muzzle device.

6. A muzzle device mounting system, comprising:

a muzzle adapter having a muzzle adapter aperture formed therethrough, wherein at least some external muzzle adapter threads are formed in an external surface of at least a first portion of said muzzle adapter, and wherein a plurality of splines are formed at spaced apart locations around a second portion of said muzzle adapter;

a muzzle device having a muzzle device recess formed therethrough;

an outer collar having an outer collar aperture formed therethrough, wherein at least some outer collar internal threads are formed within at least a portion of said outer collar aperture;

an inner collar having an inner collar aperture formed therethrough, wherein at least some inner collar threads are formed within at least a portion of said inner collar aperture, wherein said at least some inner collar threads are formed so as to threadedly interact with said at least some external muzzle adapter threads of said muzzle adapter, wherein at least some external collar threads are formed in an external portion of said inner collar, wherein said at least some external collar threads are formed so as to interact with said at least some outer collar internal threads of said outer collar, wherein a pawl lever aperture is formed through said inner collar, wherein said muzzle device is positionable at least partially between said inner collar and said outer collar, and wherein said muzzle device is at least partially rotatable relative to said outer collar and said inner collar; and a pawl lever, wherein said pawl lever is pivotably attached, via a pawl pin, between said inner collar and said outer collar, at least partially within said pawl lever aperture of said inner collar, wherein said pawl lever is at least partially pivotable between an engaged position and a disengaged position, wherein if said pawl lever is in said engaged position, a pawl extension extends to contact one or more of said plurality of splines, and wherein said pawl lever is slidable, along at least a portion of said pawl pin such that if said pawl lever is urged rearward relative to said muzzle adapter, a portion of said pawl extension is positioned over at least a portion of said plurality of splines and if said pawl lever is urged forward relative to said muzzle adapter, said pawl extension is positioned apart from said plurality of splines.

7. The muzzle device mounting system of claim 6, wherein said muzzle adapter comprises a conical taper portion formed proximate a muzzle end of said muzzle adapter.

8. The muzzle device mounting system of claim 6, wherein said muzzle device comprises a tapered recess portion formed in at least a portion of said muzzle device recess to assist in centering said muzzle device relative to said muzzle adapter.

9. The muzzle device mounting system of claim 6, wherein an inner collar pin recess extends along at least a portion of said inner collar and an outer collar pin recess extends along at least a portion of said outer collar, and wherein said pawl pin is at least partially received within at least a portion of said inner collar pin recess and at least a portion of said outer collar pin recess, such that said pawl pin acts to maintain said inner collar in a fixed rotational position relative to said outer collar.

10. The muzzle device mounting system of claim 6, wherein one or more muzzle device flats are formed within said muzzle device recess of said muzzle device for alignment of said muzzle device with said muzzle adapter.

11. The muzzle device mounting system of claim 6, wherein muzzle adapter threads are formed within at least a portion of said muzzle adapter aperture.

12. The muzzle device mounting system of claim 6, wherein a pawl tension element biases said pawl lever to said engaged position.

13. The muzzle device mounting system of claim 6, wherein if said pawl lever is in said disengaged position, said pawl extension is withdrawn from said one or more of said plurality of said splines.

14. The muzzle device mounting system of claim 6, wherein said pawl lever comprises at least some of a finger button portion and an engagement portion.

15. A muzzle device mounting system, comprising:

a muzzle adapter having a muzzle adapter aperture formed therethrough, wherein at least some external muzzle adapter threads are formed in an external surface of at least a first portion of said muzzle adapter, and wherein a plurality of splines are formed at spaced apart locations around a second portion of said muzzle adapter;

a muzzle device having a muzzle device recess formed therethrough;

an outer collar having an outer collar aperture formed therethrough, wherein at least some outer collar internal threads are formed within at least a portion of said outer collar aperture;

an inner collar having an inner collar aperture formed therethrough, wherein at least some inner collar threads are formed within at least a portion of said inner collar aperture, wherein said at least some inner collar threads are formed so as to threadedly interact with said at least some external muzzle adapter threads of said muzzle adapter, wherein at least some external collar threads are formed in an external portion of said inner collar, wherein said at least some external collar threads are formed so as to interact with said at least some outer collar internal threads of said outer collar, wherein a pawl lever aperture is formed through said inner collar, wherein said muzzle device is positionable at least partially between said inner collar and said outer collar, and wherein said muzzle device is at least partially rotatable relative to said outer collar and said inner collar; and a pawl lever, wherein said pawl lever is pivotably attached, via a pawl pin, between said inner collar and said outer collar, at least partially within said pawl lever aperture of said inner collar, wherein said pawl lever is at least partially pivotable between an engaged position and a disengaged position, wherein if said pawl lever is in said engaged position, a pawl extension extends to contact one or more of said plurality of splines and if said pawl lever is in said disengaged position, said pawl extension is withdrawn from said one or more of said plurality of said splines, and wherein said pawl lever is repeatably slidable, along at least a portion of said pawl pin such that if said pawl lever is slidably urged a sufficient distance towards said outer collar internal threads, a portion of said pawl extension is positioned over at least a portion of said plurality of splines and if said pawl lever is slidably urged a sufficient distance away from said outer collar internal threads, said pawl extension is positioned at a spaced apart location from said plurality of splines.

16. The muzzle device mounting system of claim 15, wherein said muzzle adapter comprises a conical taper portion formed proximate a muzzle end of said muzzle adapter.

17. The muzzle device mounting system of claim 15, wherein said muzzle adapter comprises one or more muzzle adapter flats, which are alignable with one or more corresponding muzzle device flats formed within said muzzle device recess of said muzzle device for alignment of said muzzle device relative to said muzzle adapter.

18. The muzzle device mounting system of claim 15, wherein an inner collar pin recess extends along at least a portion of said inner collar and an outer collar pin recess extends along at least a portion of said outer collar, and wherein said pawl pin is at least partially received within at least a portion of said inner collar pin recess and at least a portion of said outer collar pin recess, such that said pawl pin acts to maintain said inner collar in a fixed rotational position relative to said outer collar.

* * * * *